US007216590B2

(12) United States Patent
Eldridge et al.

(10) Patent No.: US 7,216,590 B2
(45) Date of Patent: May 15, 2007

(54) BULK LOADER FOR CONVEYING ARTICLES

(75) Inventors: Joseph L. Eldridge, Libertyville, IL (US); Michael K. Stoner, Waukesha, WI (US)

(73) Assignee: Nordco Inc., Oak Creek, WI (US)

( * ) Notice: Subject to any disclaimer, the term of this patent is extended or adjusted under 35 U.S.C. 154(b) by 113 days.

(21) Appl. No.: 10/374,442

(22) Filed: Feb. 25, 2003

(65) Prior Publication Data

US 2004/0163567 A1 Aug. 26, 2004

(51) Int. Cl.
*E01B 29/26* (2006.01)

(52) U.S. Cl. ..... 104/17.1

(58) Field of Classification Search ..... 104/17.1, 104/17.2, 2; 221/168, 182; 414/523, 526
See application file for complete search history.

(56) References Cited

U.S. PATENT DOCUMENTS

| | | | | |
|---|---|---|---|---|
| 2,930,473 | A | | 3/1960 | Campbell |
| 3,690,264 | A | | 9/1972 | Plasser et al. |
| 3,753,404 | A | | 8/1973 | Bryan, Jr. |
| 4,538,793 | A | | 9/1985 | Dieringer et al. |
| 4,735,343 | A | | 4/1988 | Herzog |
| 4,777,885 | A | | 10/1988 | Deiringer |
| 4,909,375 | A | | 3/1990 | Cotic et al. |
| 5,191,840 | A | | 3/1993 | Cotic et al. |
| 5,542,355 | A | * | 8/1996 | Madison et al. ..... 104/17.1 |
| 5,577,447 | A | | 11/1996 | Weber et al. |
| 5,615,990 | A | * | 4/1997 | Grieshop ..... 414/526 |
| 5,636,574 | A | * | 6/1997 | Pierrot ..... 104/17.1 |
| 6,095,053 | A | * | 8/2000 | Johnsen et al. ..... 104/17.1 |
| 6,155,175 | A | * | 12/2000 | Rude et al. ..... 104/17.1 |

FOREIGN PATENT DOCUMENTS

| | | |
|---|---|---|
| DE | 1171 718 | 6/1964 |
| DE | 29 05 492 | 8/1980 |

* cited by examiner

*Primary Examiner*—S. Joseph Morano
*Assistant Examiner*—Robert J. McCarry, Jr.
(74) *Attorney, Agent, or Firm*—Greer, Burns & Crain, Ltd.

(57) ABSTRACT

A bulk loader conveys articles in bulk and has a hopper configured for receiving the articles, such as railroad articles. A reciprocating member is configured for reciprocating between a retracted position and an extended position in a track associated with the hopper. Articles that are loaded into the hopper fall into the track when the reciprocating member is in the retracted position and are conveyed from the hopper when the reciprocating member actuates to the extended position, resulting in the removed articles being positioned in a convenient location for further handling by an operator.

14 Claims, 4 Drawing Sheets

BULK LOADER FOR CONVEYING ARTICLES

BACKGROUND

The present invention relates generally to a bulk loader for storing and conveying stick-like articles, which includes a hopper associated with a conveyor for moving articles from the hopper to a delivery point. More particularly, the present invention relates to a railroad right of way maintenance device providing a bulk spike loader system for providing railroad articles, such as spikes, from a hopper to a desired location for loading the articles into a spiker.

Among various types of railway maintenance equipment, automatic spikers are known and used for driving railroad spikes into railroad ties for securing the rail to the tie plates and tie plates to the ties. The spiker is typically mounted on a spiking machine capable of traveling over railroad tracks and may be self propelled or towable. Suitable examples of such spikers are disclosed in commonly owned U.S. Pat. Nos. 5,191,840 and 6,095,053 which are incorporated by reference. During operation of typical spikers, workers fill kegs with spikes held in a separate car or wagon, and load the filled kegs onto the spiking machine. A first worker then removes spikes from the keg, as needed, and places them in the spiker magazine. A second worker then operates the aiming and driving mechanism of the spiker to drive the spike where desired.

This conventional system requires a large amount of manual labor to load the kegs with spikes and then load the kegs onto the spiking machine. In addition, manually reaching into the kegs to get the spikes wastes further time. Furthermore, space is limited on the spiking machine, so that only a few kegs can be carried on the spiking machine at one time. This limits the production capacity of the spiking machine.

Some known solutions to the above problems such as those disclosed in commonly owned U.S. Pat. No. 6,095,053, which is incorporated by reference, have proposed using an inclined trough and auger assembly to move spikes or other rail fasteners from the hopper to a desired location for facilitating rapid loading of the fasteners by an operator into the spiker. While such solutions have improved the feeding of railroad spikes being supplied to an operator, problems such as jamming of the auger and/or an insufficient supply of the spikes reaching an operator are known to occur and consequently cause lower operator productivity. That is, productivity is limited by the number of spikes fed to the operator. When the auger becomes jammed, the spikes must be removed from the hopper to have access to those spikes which are jamming the hopper. Once the jammed spikes are disengaged from the auger, a reloading of the spikes into the spiker must occur before the spikes are again provided to the operator.

Thus, it is desirable to provide an improved bulk loader that efficiently stores and conveys relatively large quantities of articles to a desired location for further operations and that prevents jamming of the conveyed articles while they are conveyed to the desired location.

SUMMARY OF THE INVENTION

The above-identified needs are addressed by an apparatus configured for bulk feeding articles, such as railroad spikes. Features of the present invention include a bulk loader having a hopper that receives and stores the articles for later selected use by an operator. A preferably recessed track is provided for guiding a reciprocating member. The reciprocating member is configured for reciprocating between a retracted position wherein the articles may fall into the track, and an extended position wherein the reciprocating member conveys those articles positioned within the track to a position where they may be accessed by an operator. Movement of the reciprocating member between the retracted and extended positions may be controlled by an operator to facilitate positioning of the articles in a convenient location for further handling by the operator.

DESCRIPTION OF THE PREFERRED EMBODIMENT

Figure 1:
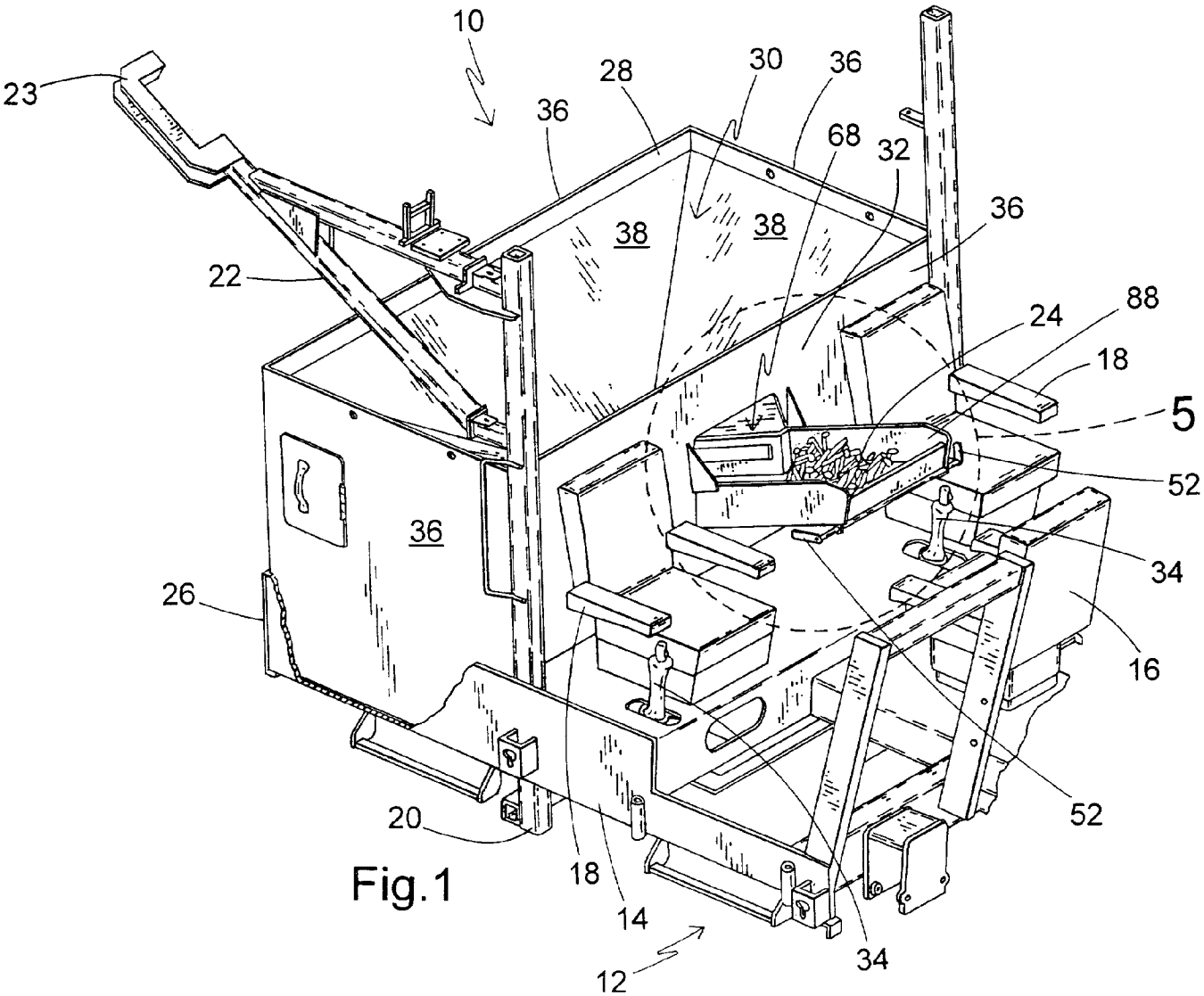
FIG. 1 is a fragmentary top perspective view of a spiking machine fitted with a bulk loader incorporating the features of the present invention.
Figure 2:
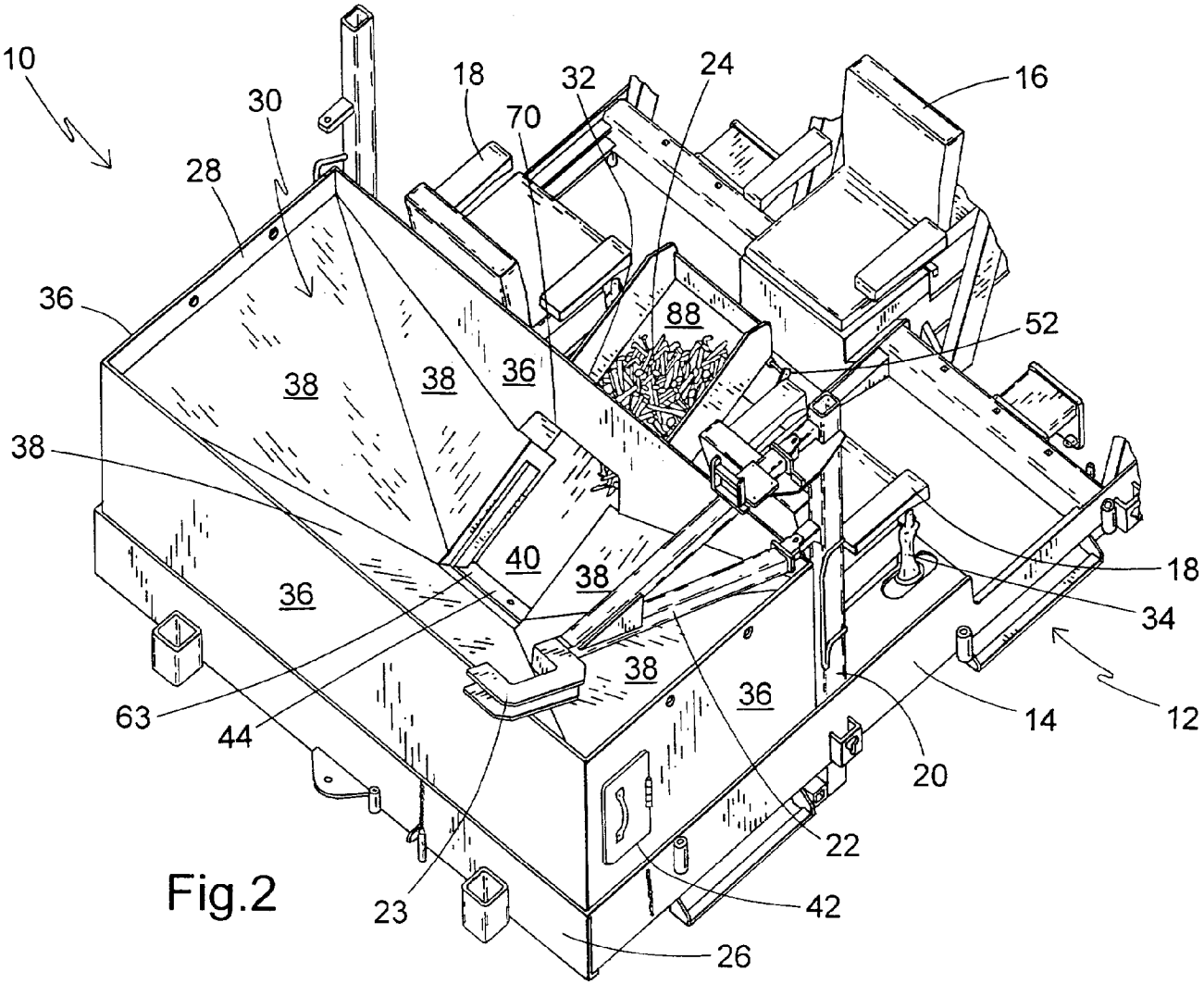
FIG. 2 is a fragmentary top perspective view of the spiking machine of FIG. 1 shown from a position rearward of the operator.

Referring now to FIGS. 1 and 2, a bulk loader, generally designated 10, is shown on a portion of a spiking machine, generally designated 12. As is well known in the art, the spiking machine 12 is designed to be self propelled or towed as a separate unit along a railroad track. The spiking machine 12 preferably includes a frame 14 supporting, among other things, the bulk loader 10, an operator seat 16 facing the bulk loader, operator seats 18 facing a spiker mechanism (not shown) and a post 20 supporting a boom 22. The boom 22 supports a hook 23 that may be used to hoist containers of articles 24 such as cut spikes, lag screws, anchors, screw spikes, clips, or the like (collectively referred to as spikes) which are deposited in bulk into a portion of the bulk loader 10. Alternatively, a pay loader having an electromagnet can load the spikes 24 directly into the bulk loader 10.

The frame 14 also defines a retaining wall 26 for receiving and holding the bulk loader 10. As best seen in FIG. 2, the bulk loader 10 rests within a space defined by the retaining wall 26. The frame 14 also preferably supports a hopper 28, which is a portion of the loader 10 and is configured for receiving the spikes 24. In the preferred embodiment, the bulk loader 10 is loaded with the spikes 24, by a payloader having an electromagnet or by other lifting devices known in the art which are capable of depositing the spikes into the hopper 28. After the positioning of the bulk loader 10, the spikes 24 are conveyable from an interior portion 30 of the hopper 28 to an exterior portion 32 of the hopper which includes outer surfaces of external sidewalls 36. In addition to the sidewalls 36, the exterior portion 32 may include a separate or integral bin, tray, or the like that is external to the interior portion, and which is positioned to receive the spikes 24 that are pushed out of the hopper 28. In this manner, operators seated in the seats 16 and 18 have convenient access to the spikes once they are removed from the interior portion of the hopper 28. Additionally, controls (not shown) are provided to operate the spiking machine 12.

Figure 3:
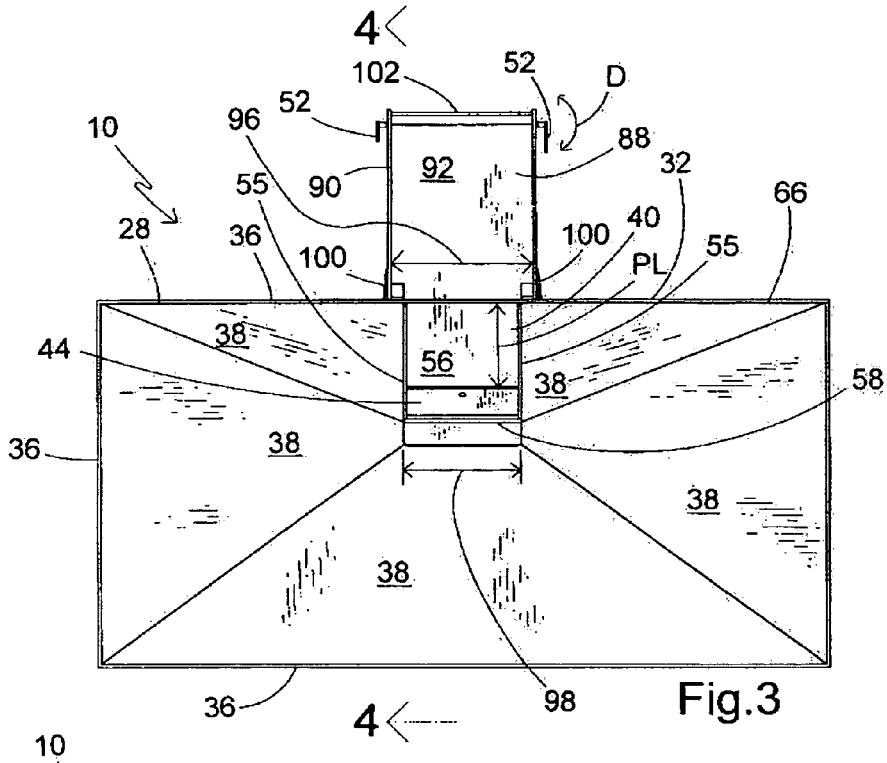
FIG. 3 is a top view of the bulk loader of the present invention.

Referring now to FIGS. 1–3, the hopper 28 preferably has a generally rectangular configuration with four sidewalls 36. The interior portion 30 of the hopper 28 is further defined by radially inward sloping or generally funnel shaped surfaces 38 that are configured to direct the spikes 24 deposited into the hopper to a centrally located, recessed track 40, which is positioned at the bottom of the hopper. One feature of the hopper 28 is that each of the sidewalls 36 can include a door 42 (one shown) for storing tools and other equipment within the bulk loader 10. This is advantageous, since operators are thus provided ready access to tools and equipment while the spiking machine 12 is in the field inserting and/or removing the spikes 24 from sections of the railroad track (not shown).

Referring now to FIGS. 1–4, one feature of the present bulk loader 10 is that it includes a reciprocating member or pusher 44 that reciprocates between a retracted position shown in FIGS. 1–4 and an extended position (shown in phantom in FIG. 4) wherein the pusher extends to an end 45 of the track 40. While the pusher 44 is in the retracted position, some of the spikes 24 held in the hopper 28 fall into the track 40. Once the pusher 44 moves to the extended position, those spikes 24 that have fallen into the track 40 are pushed or conveyed to the exterior portion 32, and preferably to a location where operators can access the conveyed spikes. Preferably, the track 40 is formed to have a length TL that is equal to or greater than a length PL of a stroke of the pusher 44, however it is contemplated that the pusher could have a stroke that stops before or extends beyond the end 45 of the track 40.

Figure 4:
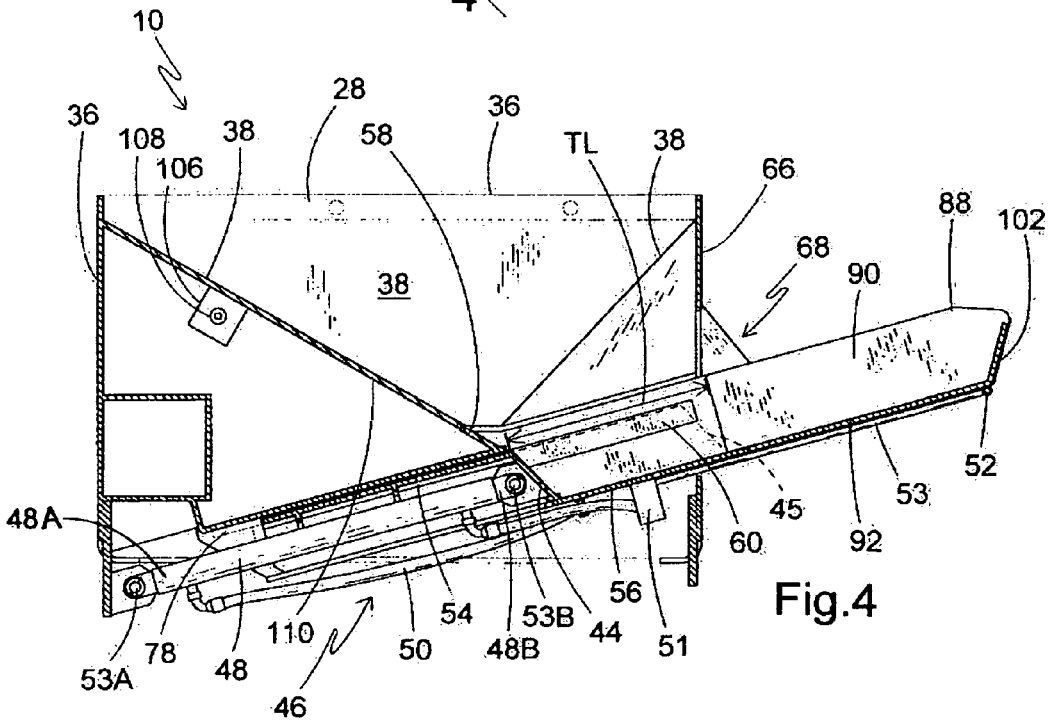
FIG. 4 is a sectional view taken along the line 4—4 of FIG. 3 and in the direction generally indicated.

Referring now to FIG. 4, the pusher 44 is reciprocated by a fluid power apparatus, generally designated 46, which includes a fluid power cylinder 48 and a hose 50 connecting the cylinder to a valve 51. A lever 52 (FIG. 3) connects via a linkage 53 to the valve 51 and can be rotated in a clockwise or counterclockwise direction D as viewed in FIG. 3 to operate the fluid power apparatus 46. As described in detail below, the preferably hydraulic fluid power apparatus 46 extends and retracts the pusher 44. A first end 48A of the cylinder 48 is secured to a clevis flange 53A on the hopper 28. A second end 48B of the cylinder 48 is secured to a clevis flange or eyelet 53B on an interior surface 54 of the pusher 44. It is contemplated that either the first end 48A or the second end 48B can be the rod end of the cylinder 48, and the other end will be the blind end. In operation, pressurization of the cylinder 48 at its respective ends extends and retracts the pusher 44. While a double acting cylinder 48 is depicted, it is also contemplated that a single acting, spring-return cylinder could also be employed in this application. Furthermore, while a hydraulic fluid power apparatus 46 is shown and described, it is contemplated that various pneumatic and other piston driven assemblies may be implemented with the present invention as is known to those skilled in the art.

Referring now to FIGS. 1–6, the track 40 has a pair of sidewalls 54 55 and a bottom 56 that are positioned within the interior portion 30 to be disposed in an operational relationship with the pusher 44. A rear wall 58 defines an opening 59 (FIG. 5) of the track 40 configured for receiving the pusher 44 therethrough as the pusher extends toward the end 45 of the track. When the hopper 28 is filled, a portion of the spikes 24 deposited within the interior portion 30 of the hopper fall to the bottom 56 of the track 40 and are removed from the interior portion upon extension of the pusher 44.

Figures 5, 6:
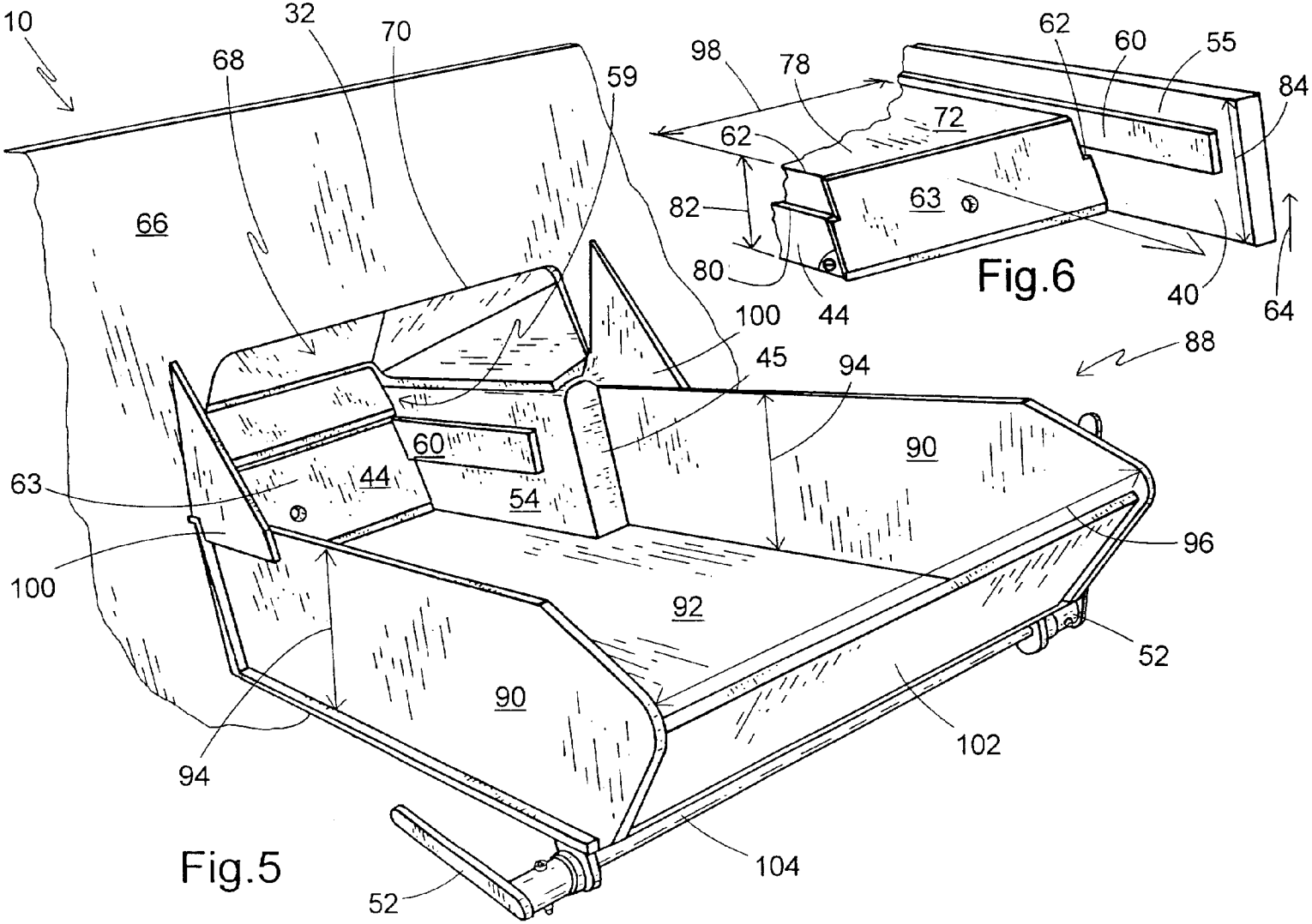
FIG. 5 is an enlarged fragmentary perspective view of a portion of the bulk loader as shown in FIG. 4.
FIG. 6 is a fragmentary perspective view of a pusher as shown in FIG. 5.

One feature of the track 40 is that it includes at least one guide 60 (FIG. 5) on each of the sidewalls 54, 55, the guides being constructed and arranged so that the pusher 44 and the spikes 24 pushed by it are aligned in the track. By slidably engaging shoulders 62 on at least a front face 63 of the pusher 44, the guides 60 prevent upward movement of the pusher in the direction of an arrow 64 (shown in FIG. 6). In this manner, a desired linear reciprocation of the pusher 44 is maintained in the track 40. Moreover, as best seen in FIGS. 5 and 6, a close tolerance is maintained between the pusher 44 and the sidewalls 54, 55 so that the spikes 24 are prevented from becoming lodged between the pusher and the sidewalls. As such, jamming is prevented.

Referring now to FIGS. 5 and 6, another feature of the present bulk loader 10 is that a front side 66 of the hopper 28 has an opening 68 in registry with the track 40 that is configured for accommodating passage of the spikes 24 pushed out of the track by the pusher 44. The opening 68 must be of sufficient size to enable a sufficient amount of the spikes 24 to pass through for each stroke of the pusher 44 to take full advantage of the capacity of the track 40, while still preventing the pile of pushed spikes 24 from becoming jammed in the opening. In particular, an edge 70 of the front side 66 is positioned sufficiently above a top portion 72 of the pusher 44 so that the spikes 24 do not become jammed between the pusher and the edge as the pusher extends to the end 45 of the track 40.

Another feature of the present bulk loader 10 is that the top portion 72 of the pusher 44 is generally planar to provide a minimum clearance with the rear wall 58. This minimum clearance enables slidability between the pusher and the wall, yet prevents the spikes 24 from becoming jammed behind a rear portion 78 of the pusher 44. Moreover, sidewalls 80 (one shown in FIG. 6) of the pusher 44 are generally vertical and planar, promoting a smooth sliding relationship of the pusher 44 in the track 40.

A height 82 of the sidewalls 80 of the pusher 44 is preferably less than a height 84 of the track 40 to prevent jamming of the spikes 24 in the opening 68 upon extension of the pusher. However, it is contemplated in the present invention that the height 82 of the sidewalls 80 may be equal to or less than the height 84 of the pusher 44. In the preferred embodiment, the front face 63 of the pusher 44 may be inclined at an acute angle θ relative to the bottom 56 of the track 40 (FIGS. 3 and 4) to further prevent jamming of the spikes 24 when the pusher 44 extends by allowing the spikes to move in an upwards direction as viewed in FIG. 4.

Referring now to FIGS. 3 and 5, the exterior portion 32 of the hopper 28 is provided in the form of an access bin 88 for receiving the spikes 24 conveyed by the pusher 44 from the interior portion 30 of the hopper 28. The access bin 88 is connected to the front side 66 of the hopper 28 and has a pair of sidewalls 90 and a bottom 92 which are configured for containing and receiving the spikes 24 pushed from the interior portion 30 by the pusher 44. That is, the sidewalls 90 have a height 94 that is greater than or equal to the height 82 of the sidewalls 80 of the pusher 44 (FIG. 3). Moreover, the bottom 92 of the access bin 88 has a width 96 greater than or equal to a width 98 of the pusher 44. An advantage of the relatively wider and larger volume access bin 88 is that a load of the spikes 24 conveyed by the pusher 44 will spread out and/or settle in the bin. In this way, they become easier to retrieve by the operators, who typically reach for the spikes from a seated position. While preferably attached to the hopper 28, the access bin 88 may also be a separate unit placed in operational relationship to the hopper.

Another feature of the access bin 88 is that it preferably includes a pair of gussets 100 that connect to the front side 66 and the sidewalls 90 of the access bin. The gussets 100 act as shielding members to further prevent the spikes 24 positioned near the edge 70 of the opening 68 from escaping the access bin 88. In addition, the gussets 100 provide extra support for the cantilevered access bin 88. The access bin 88 also includes a front panel 102 which is attached to free ends of the sidewalls 90 and the bottom 92, and closes off the bin and retains the spikes 24. While preferably inclined forward, the orientation of the panel may vary to suit the application. FIG. 5 also provides a detailed view of a shaft 104 which connects the rotatable pusher actuator levers 52, preferably located on each side of the access bin 88.

As illustrated in FIG. 4, the present bulk loader 10 is also optionally provided with a vibration motor 106 for vibrating the hopper 28 to facilitate movement of the spikes 24 into the track 40. In the preferred embodiment, the motor 106 is hydraulic, with a rotating eccentric hammer 108, but electrical or other types of vibrators are contemplated. The vibration motor 106 is connected (e.g., by skip welding) to an underside 110 of the hopper 28. Skip welding helps to transfer the forces generated by the vibration motor 106 to the inclined surfaces 38 of the hopper 28.

In operation, the bulk loaded spikes 24 are preferably cut spikes, but are also contemplated as being hairpin spikes, lag screws, rail anchors or even rail clips, and are loaded in random or bulk fashion into the hopper 28 using, for example, the boom 23. The spikes 24 are then directed toward the recessed track 40 by vibration from the vibration motor 106 and/or the inclined slope of the inclined surfaces 38 of the hopper 28. When the pusher 44 is retracted, a group of the spikes 24 slide into the track 40. Upon extension of the pusher 44 to the extended position, this group of spikes 24 is transferred to the access bin 88. Upon reaching the access bin 88, the spikes 24 spread out and/or settle on the bottom 92 of the access bin until removed by an operator. After the access bin 88 is emptied of the spikes 24, the operator may reciprocate the pusher 44 to receive a new supply of spikes in the access bin.

Thus, the present bulk loader 10 provides several features designed to address the particular problems of conveying spikes 24 in bulk, such as rail spikes. These features include the use of the reciprocating pusher 44 which employs a relatively simple mechanism for pushing the spikes 24 along the recessed track 40 without experiencing down time due to jammed spikes. In addition, the track 40 includes guides 60 that limit vertical movement of the pusher 44 relative to the bottom 56 and sidewalls 55 of the track, and thus maintain pusher alignment. Furthermore, once the spikes 24 pass through the opening 68 to the access bin 88, they settle and are more easily accessible due to the larger volume access bin.

While a particular embodiment of the bulk spike loader apparatus of the invention has been shown and described, it will be appreciated by those skilled in the art that changes and modifications may be made thereto without departing from the invention in its broader aspects and as set forth in the following claims.

What is claimed is:

1. A bulk loader for conveying articles in bulk, comprising:

a hopper configured for receiving the unsorted, randomly positioned articles therein;

a reciprocating member located at a bottom of said hopper, and configured for operationally reciprocating between a first, retracted position during which a plurality of the unsorted, randomly positioned articles are received by gravity flow from said hopper and a second, extended position for pushing and conveying the plurality of the unsorted, randomly positioned articles against gravity flow from said bottom of said hopper; and a track fixed in said hopper and constructed and arranged for receiving the plurality of articles, and accommodating reciprocating action of said reciprocating member relative to said track between said first and said second positions, so that upon reaching said second position, said reciprocating member pushes the plurality of articles from said hopper and from said track.

2. The bulk loader as defined in claim 1, wherein said track is upwardly inclined in a direction of movement of articles in said track.

3. The bulk loader as defined in claim 2, wherein said track further includes at least one guide constructed and arranged so that at least some of the plurality of articles are upwardly movable in said track upon extension of the reciprocating member from said first position to said second position.

4. The bulk loader as defined in claim 2, wherein the track has a length that is one of equal to and greater than a length of a stroke of the reciprocating member.

5. The bulk loader as defined in claim 2, wherein said reciprocating member has a top, sidewalls and a front face configured for preventing the articles deposited within said hopper from becoming jammed between said reciprocating member and said track, said front face forming a wall of said track.

6. The bulk loader as defined in claim 1, further comprising a fluid power apparatus configured for moving said reciprocating member between said first and second positions.

7. The bulk loader as defined in claim 2, wherein said hopper has a front side provided with an opening in registry with said track, said opening configured for accommodating the plurality of the articles pushed in said track by the reciprocating member extending from said first position to said second position.

8. The bulk loader as defined in claim 2, further comprising an access bin in alignment with said track and having a width greater than a width of said track.

9. The bulk loader as defined in claim 1, further including at least one control member configured for controlling reciprocation of said reciprocating member.

10. The bulk loader as defined in claim 2, further including a vibrator mechanism configured for vibrating said hopper and causing the articles to move freely toward said track.

11. The bulk loader as defined in claim 1, wherein during said second, extended position, said plurality of unsorted, randomly positioned articles are conveyed from said hopper into an upwardly inclined access bin.

12. A rail maintenance apparatus having a machine for removing or installing railroad articles, comprising:

a frame;

a bulk loader positioned on said frame, said bulk loader including:

a hopper having a portion configured for receiving the unsorted, randomly positioned articles and at least one wall provided with an opening;

a pusher located at a bottom of said hopper and configured for generally linearly reciprocating between a first, retracted position during which a plurality of the unsorted, randomly positioned articles are received from said hopper and a second position wherein a front face of said pusher is moved towards said opening for upwardly pushing the plurality of the received articles from said hopper; and a track configured for receiving the plurality of the articles, said track being fixed in said hopper, upwardly inclined in the direction of movement of the articles from said hopper and constructed and arranged for accommodating reciprocating action of said pusher relative to said track between said first and second positions.

13. The maintenance apparatus as defined in claim 12, further including an access bin in alignment with said track and configured for receiving the plurality of the articles removed from said hopper upon said pusher extending from said first position to said second position.

14. A pusher for a bulk spike loader configured for conveying unsorted, randomly positioned railroad articles in bulk, the bulk spike loader having a hopper for depositing the unsorted, randomly positioned articles and a fixed track therein for receiving and guiding at least some of the articles as said pusher reciprocates between a retracted position during which a plurality of the unsorted, randomly positioned articles are received in the fixed track and an extended position, said pusher including a front face configured for pushing the plurality of articles through an opening in the hopper, and a top portion for preventing the articles from contacting the track upon said pusher being in said extended position, said front face forming a wall of the track, said pusher moving the plurality of articles from the hopper in said extended position.

* * * * *